US008497473B2

(12) United States Patent
Kertesz et al.

(10) Patent No.: US 8,497,473 B2
(45) **Date of Patent: *Jul. 30, 2013**

(54) ELECTROSPRAY ION SOURCE WITH REDUCED ANALYTE ELECTROCHEMISTRY

(75) Inventors: Vilmos Kertesz, Knoxville, TN (US); Gary J. Van Berkel, Oak Ridge, TN (US)

(73) Assignee: UT-Battelle, LLC, Oak Ridge, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/207,783

(22) Filed: Aug. 11, 2011

(65) Prior Publication Data

US 2012/0043473 A1 Feb. 23, 2012

Related U.S. Application Data

(63) Continuation of application No. 12/237,892, filed on Sep. 25, 2008, now Pat. No. 8,003,937.

(51) Int. Cl.
*H01J 49/10* (2006.01)

(52) U.S. Cl.
USPC ..... 250/288; 250/281

(58) Field of Classification Search
USPC ..... 250/288, 281
See application file for complete search history.

(56) References Cited

U.S. PATENT DOCUMENTS

| | | | | |
|---|---|---|---|---|
| RE34,757 | E * | 10/1994 | Smith et al. | 204/452 |
| 7,619,216 | B1 * | 11/2009 | Whitehouse et al. | 250/288 |
| 8,003,937 | B2 * | 8/2011 | Kertesz et al. | 250/288 |
| 2004/0016878 | A1 * | 1/2004 | Schultz et al. | 250/281 |
| 2005/0258360 | A1 * | 11/2005 | Whitehouse et al. | 250/288 |
| 2008/0182136 | A1 * | 7/2008 | Arnold et al. | 429/7 |
| 2011/0040147 | A1 * | 2/2011 | O'Dea et al. | 600/104 |

* cited by examiner

*Primary Examiner* — Phillip A Johnston
*Assistant Examiner* — Johnnie L Smith
(74) *Attorney, Agent, or Firm* — Novak Druce Connolly Bove + Quigg LLP

(57) ABSTRACT

An electrospray ion (ESI) source and method capable of ionizing an analyte molecule without oxidizing or reducing the analyte of interest. The ESI source can include an emitter having a liquid conduit, a working electrode having a liquid contacting surface, a spray tip, a secondary working electrode, and a charge storage coating covering partially or fully the liquid contacting surface of the working electrode. The liquid conduit, the working electrode and the secondary working electrode can be in liquid communication. The electrospray ion source can also include a counter electrode proximate to, but separated from, said spray tip. The electrospray ion source can also include a power system for applying a voltage difference between the working electrodes and a counter-electrode. The power system can deliver pulsed voltage changes to the working electrodes during operation of said electrospray ion source to minimize the surface potential of the charge storage coating.

14 Claims, 7 Drawing Sheets

ELECTROSPRAY ION SOURCE WITH REDUCED ANALYTE ELECTROCHEMISTRY

CROSS REFERENCE TO RELATED APPLICATIONS

This application is a continuation of U.S. patent application Ser. No. 12/237,892, entitled "Electrospray Ion Source with Reduced Analyte Electrochemistry," filed Sep. 25, 2008, the entirety of which is incorporated herein by reference.

STATEMENT REGARDING FEDERALLY SPONSORED RESEARCH OR DEVELOPMENT

This invention was made with government support under Contract No. ERK CC-42 awarded by the U.S. Department of Energy. The Government has certain rights in the invention.

FIELD OF THE INVENTION

The present invention relates to an electrospray ionization source and methods of using the same.

BACKGROUND OF THE INVENTION

Electrospray ion (ESI) sources are used to produce gas phase analyte ions for analysis by analytical instruments, such as mass spectrometers. Under common ESI Mass Spectrometry (MS) conditions most analytes are not directly effected by the electrochemical process occurring while passing through the ESI source. Nonetheless, electrochemical reactions of analytes of interest can and do take place. These electrochemical reactions can alter the analyte molecules such that the ions observed in the gas phase have a different mass, charge, or both, than the original analyte molecule. In contrast, planned analyte electrochemistry can be very advantageous, providing the ability to create novel ionic species, probe analyte redox chemistry, and perform electrochemical ionization.

In general, problems with ESI source analyte electrochemistry arise where the analyte has a low oxidation or high reduction potential relative to the surface potential generated at the electrode surface in order to produce the current required for ionization. Several reports propose to eliminate this effect using homogeneous redox buffer solutions or sacrificial electrode materials to buffer the potential of the emitter to a degree where analyte electrochemistry does not take place. Unfortunately, both methods introduce products of the buffering reaction in the solution that may have unwanted effects. For example, the hydroquinone oxidation product benzoquinone can react with thiol moieties in an analyte resulting in an unintended mass shift in the mass spectrum, and oxidation of a sacrificial metal electrode introduces metal ions in the solution that may act as complexing agents thereby changing the characteristics of the mass spectrum.

An article by Van Berkel et al. discloses that it is possible to minimize electrochemical analyte reactions using controlled-potential systems. Gary J. Van Berkel and Kertesz, V., "Using the Electrochemistry of the Electrospray Ion Source," Analytical Chemistry, p. 5510-5520 (Aug. 1, 2007). The Van Berkel article proposes to eliminate the undesirable electrochemical analyte reactions by adjusting the current supplied to the working electrode to prevent undesirable electrochemical reactions.

SUMMARY OR THE INVENTION

In one embodiment, the invention is drawn to an electrospray ion (ESI) source that includes an emitter. The emitter can include a liquid conduit, a primary working electrode having a liquid contacting surface, a spray tip, a secondary working electrode, a charge storage coating covering partially or fully the liquid contacting surface of the working electrodes, and a counter electrode proximate to, but separated from, said spray tip. The liquid conduit and the working electrodes can be in liquid communication with one another. The ESI source can also include a power system for supplying voltage to the working electrodes. The power system can be controlled by a processor for delivering a pulsed voltage change to the working electrodes during operation of the electrospray ion source.

The charge storage coating can cover partially or fully the liquid contacting surface of the one or both of the working electrodes.

The ESI source can also include a sensor for detecting a parameter of the charge storage coating in communication with the processor. The parameter can be one or more of surface potential, color, conductivity, parameters related to oxidation state, and combinations thereof.

The power system can be designed to automatically deliver a second pulsed voltage change to the secondary working electrode. The second pulsed voltage change can be delivered during at least a portion of the pulsed voltage change. The pulsed voltage changes can include reversing polarity of the voltage supplied to one or both of the working electrodes. The pulsed voltage change can last for less than 1 second.

The charge storage coating comprises a material selected from a electrochemically active polymer, inorganic dielectric material, and combinations thereof. The charge storage coating can be a electrochemically active polymer selected from the group including, but not limited to, a poly(acetylene), a poly(pyrrole), a poly(thiophene), a poly(aniline), a poly(fluorene), a poly(3-alkylthiophene), a polytetrathiafulvalene, a polynaphthalene, a poly(p-phenylene sulfide), a poly(phenylene vinylene), a poly(paraphenylene), a poly(viologen), and copolymers and mixtures thereof.

The charge storage coating can be an inorganic dielectric material selected from the group including, but not limited to, barium titanate, zirconium barium titanate, strontium titanate, calcium titanate, magnesium titanate, calcium magnesium titanate, zinc titanate, lanthanum titanate, neodymium titanate, barium zirconate, calcium zirconate, lead magnesium niobate, lead zinc niobate, lithium niobate, barium stannate, calcium stannate, magnesium aluminium silicate, magnesium silicate, barium tantalate, titanium dioxide, niobium oxide, zirconia, silica, sapphire, beryllium oxide, zirconium tin titanate, and combinations thereof.

In another embodiment, the invention can be a method of producing gas phase ions of an analyte of interest. The method can include providing an electrospray ion source that can have a liquid conduit, a primary working electrode having a liquid contacting surface, a charge storage coating disposed partially or fully over the liquid contacting surface, and a counter electrode proximate to, but separated from, said liquid conduit. The working electrode and the liquid conduit can be in liquid communication. Liquid that includes an analyte of interest can be conveyed through the liquid conduit. A first voltage can be applied to the primary working electrode. A pulsed voltage change can be applied to the primary working electrode, wherein the pulsed voltage change is sufficient to reduce the charge storage coating.

The method can include applying a first voltage to said working electrode, wherein said first voltage is interrupted by one or more pulsed voltage changes. The one or more pulsed voltage changes can maintain a surface potential of a liquid contacting surface of the charge storage coating below a threshold necessary to cause electrochemistry with the analyte of interest.

The pulsed voltage change can include applying to the primary working electrode a voltage having a polarity opposite that of said first voltage. The duration of the pulsed voltage change can be any duration, including 1 second or less or a duration sufficient to maintain a surface potential of a liquid contacting surface of the charge storage coating below a threshold necessary to cause electrochemistry with the analyte of interest.

The ESI source can include a secondary working electrode in liquid communication with the primary working electrode and the liquid conduit. The method can also include applying a secondary voltage to the secondary working electrode, applying a secondary pulsed voltage change to the secondary working electrode, or both. The secondary pulsed voltage change and the primary pulsed voltage change can overlap. The secondary working electrode can include a secondary liquid contacting surface having a secondary charge storage coating disposed over fully or partly the secondary liquid contacting surface.

These and other embodiments are described in more detail below.

BRIEF DESCRIPTION OF THE DRAWINGS

A fuller understanding of the present invention and the features and benefits thereof will be obtained upon review of the following detailed description together with the accompanying drawings, in which.

DETAILED DESCRIPTION

This invention is drawn to an electrospray ion source emitter that prevents the analyte of interest from undergoing electrochemical reactions. The inventive electrospray ion source allows more accurate analytical measurements of low oxidation potential analytes and high reduction potential analytes. The invention is also drawn to a method of producing gas phase ions of an analyte of interest while preventing electrochemical reactions thereof.

Figure 1:
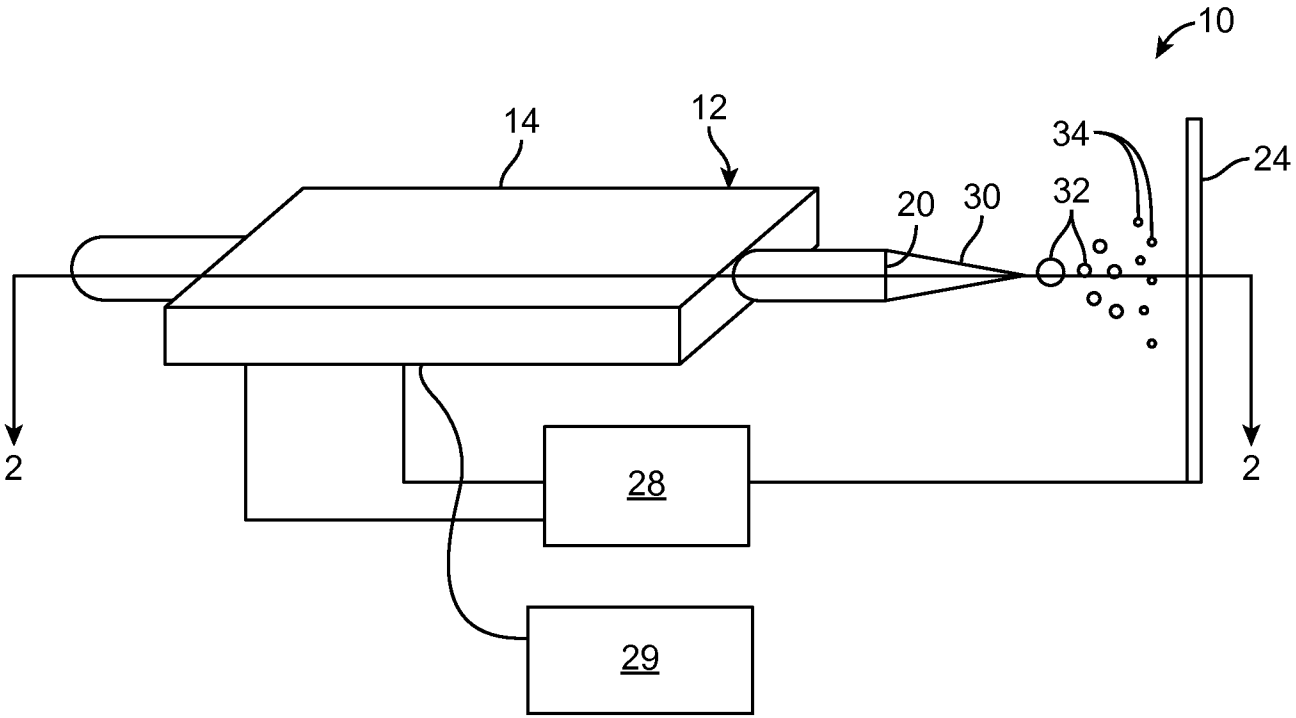
FIG. 1 is a perspective view of an electrospray ion source of the invention.
Figure 2:
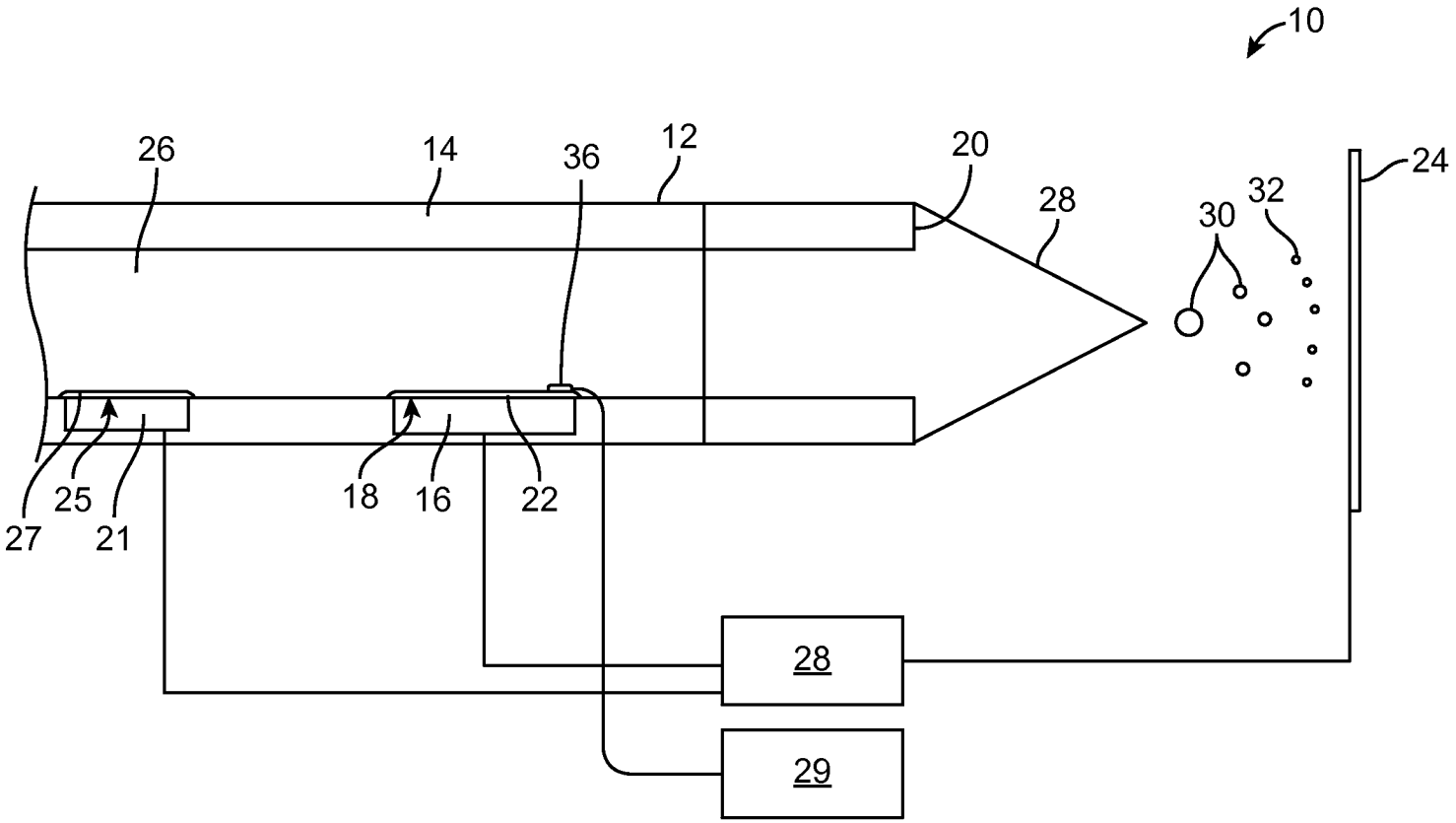
FIG. 2 is a cross-sectional view of the electrospray ion source in FIG. 1, taken along cut line 2-2.
Figure 3:
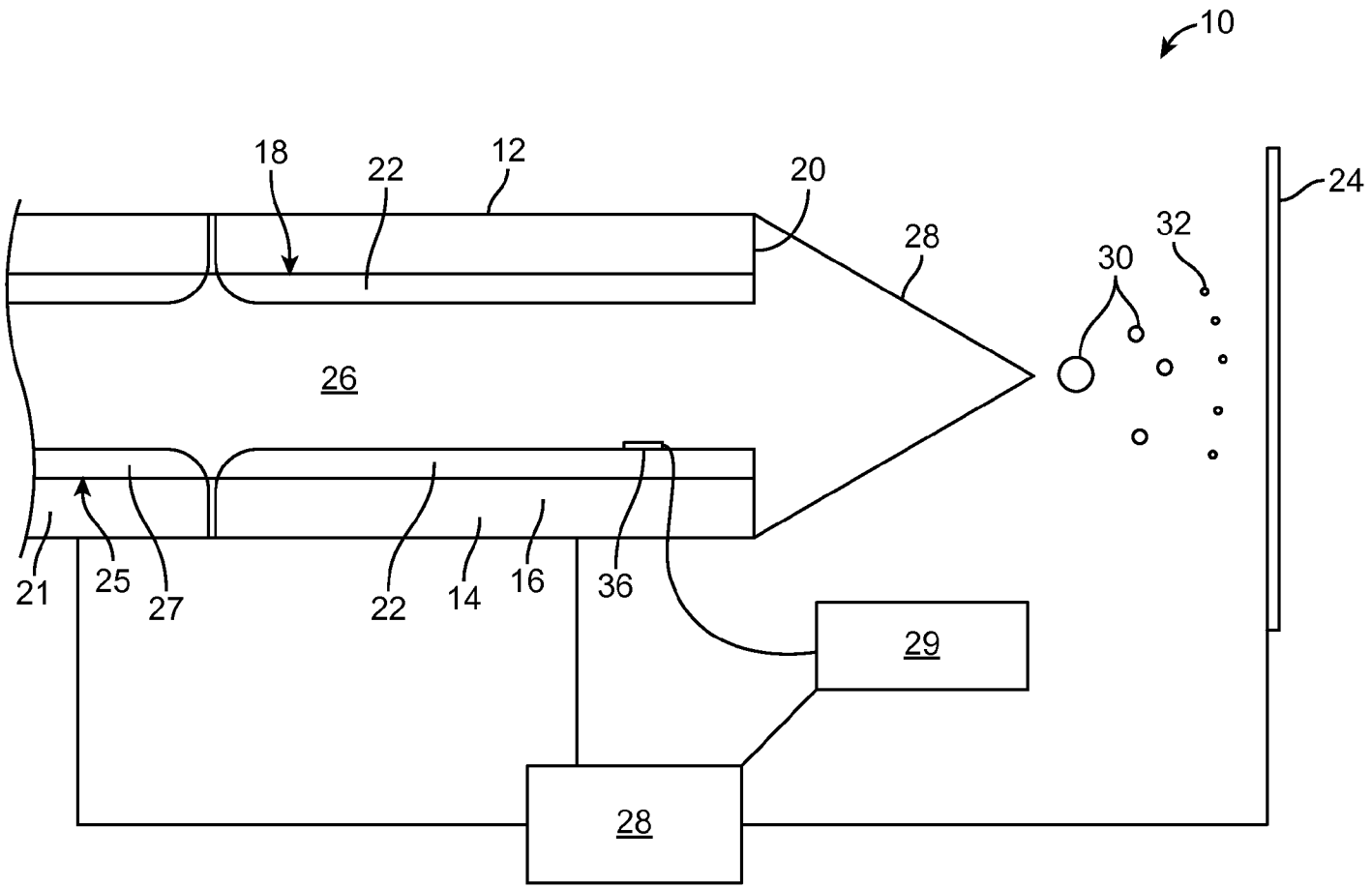
FIG. 3 is a cross-sectional view of the electrospray ion source in FIG. 1, taken along cut line 2-2, where the liquid conduit and the working electrode are the same.

As shown in FIGS. 1-3, the invention is an electrospray ionization source 10 that can include an emitter 12 that can include a liquid conduit 14, a working electrode 16 having a liquid contacting surface 18, a spray tip 20, a secondary working electrode 21, and a charge storage coating 22 covering fully or partially the liquid contacting surface 18 of the primary working electrode 16. The liquid conduit 14, the primary working electrode 16 and the secondary working electrode 21 can be in liquid communication. The electrospray ion source 10 can also include a counter electrode 24 proximate to, but separated from, the spray tip 20. The emitter 12 and the counter electrode 24 can be arranged such that liquid 26 exiting the emitter 12 can be directed toward the counter electrode 24. The electrospray ion source 10 can also include a power system 28 for supplying voltage to the primary working electrode 16 and the secondary working electrode 21. The power system 28 can also supply a voltage difference between the working electrodes 16 and 21 and the counter-electrode 24. The power system 28 can be controlled by a processor for delivering pulsed voltage changes to the working electrodes 16 and 21 during operation of said electrospray ion source 10.

The primary and secondary charge storage coatings 22 and 27 can fully or partially cover the liquid contacting surface 18, 25 of the working electrodes 16 and 21, respectively. The primary and secondary charge storage coatings 22 and 27 can cover at least 5% of the liquid contacting surface of one or both working electrodes 16 and 21, or at least 15%, or at least 25%, or at least 50%, or at least 75%, or at least 80%, or at least 95%, or at least 97.5%, or at least 99% or 100% of the liquid contacting surface 18, 25 of one or both working electrodes 16 and 21.

As shown in FIGS. 2 and 3, the electrospray ion source 10 can include a secondary working electrode 21 upstream of the primary working electrode 16. The working electrodes 16 and 21 can be electrically isolated from one another. The liquid conduit 14 and the secondary working electrode 21 can be in liquid communication and the secondary working electrode 21 can have a liquid contacting surface 25. The liquid contacting surface 25 of the secondary working electrode 21 can be coated with a second charge storage coating 27.

The secondary working electrode 21, the primary working electrode 16, and the MS front plate, or counter electrode, 24 can be attached to the same power system 28. As used herein, the power system 28 can include one or more power sources for supplying voltage to the working electrodes 21 and 16, the counter electrode 24, and any other electrodes requiring a voltage supply. The power system 28 can be designed to apply voltage to the working electrodes 16 and 21 independently. Whether separate power sources are employed or not, the power system 28 can be controlled by a processor 29 capable of controlling and coordinating the voltage pulses described herein. The function of the processor 29 can be performed by one or more processors. The processor 29 can be part of a computer.

The power system 28 can be capable of reversing the polarity of the voltage difference between the counter-electrode 24 and one or both working electrodes 16 and 24. The voltage supplied by the power system 28 can be controlled by an isolated potentiostat-isolation transformer arrangement. Such a power supply arrangement is disclosed in Gary J. Van Berkel and Kertesz, V., "Using the Electrochemistry of the Electrospray Ion Source," Analytical Chemistry, p. 5510-5520 (Aug. 1, 2007), the entirety of which is incorporated herein by reference.

The working electrode 16 can be some or, as shown in FIG. 3, all of the liquid conduit 14. The charge storage coating 22 can coat the entire liquid contacting surface 18 of the working electrode 16. Similarly, the second charge storage coating 27 can coat the entire liquid contacting surface 25 of the secondary working electrode 21. As will be apparent, the working electrode 16 and the secondary working electrode 21 can be electrically isolated from one another, so that charge from one is not transferred to the other.

The features of the inventive electrospray ion source 10 can be incorporated into conventional electrospray ion emitters including, but not limited to, grounded emitters, floated emitters, controlled-potential electrochemistry electrospray emitters, either with or without an upstream ground. Several examples can be found in Gary J. Van Berkel and Kertesz, V., "Using the Electrochemistry of the Electrospray Ion Source," Analytical Chemistry, p. 5510-5520 (Aug. 1, 2007).

Although the exact mechanism of analyte ion formation is not critical to practicing the invention, the following explanation of the formation of the individual analyte ions 34 is provided. The liquid 26 exiting the spray tip 20 will form a Taylor cone 30 before separating into analyte ion containing droplets 32 due, in part, to the charge accumulation in the liquid 26. The droplets 32 continue to subdivide until the liquid portion evaporates leaving gas-phase, individual analyte ions 34. These gas-phase analyte ions 34 can then be analyzed using an analytical instrument (not shown), such as a mass spectrometer. The voltage applied to the working electrode 16, the secondary working electrode 21, or both, can be sufficient to supply gas-phase analyte ions for evaluation by a downstream analytical device, such as a mass spectrometer.

As used herein, the term "liquid conduit" is used to describe any conduit used for conveying liquid downstream of the spray tip. The liquid conduit can be any shape including, but not limited to, tubular, hexahedral, e.g., regular hexahedral, cuboid, etc., or a combination thereof. The liquid conduit can have a constant cross-sectional shape. However, it should be noted that it is not critical that the shape of the liquid conduit be constant along its length, as shown in FIG. 1.

Figure 4:
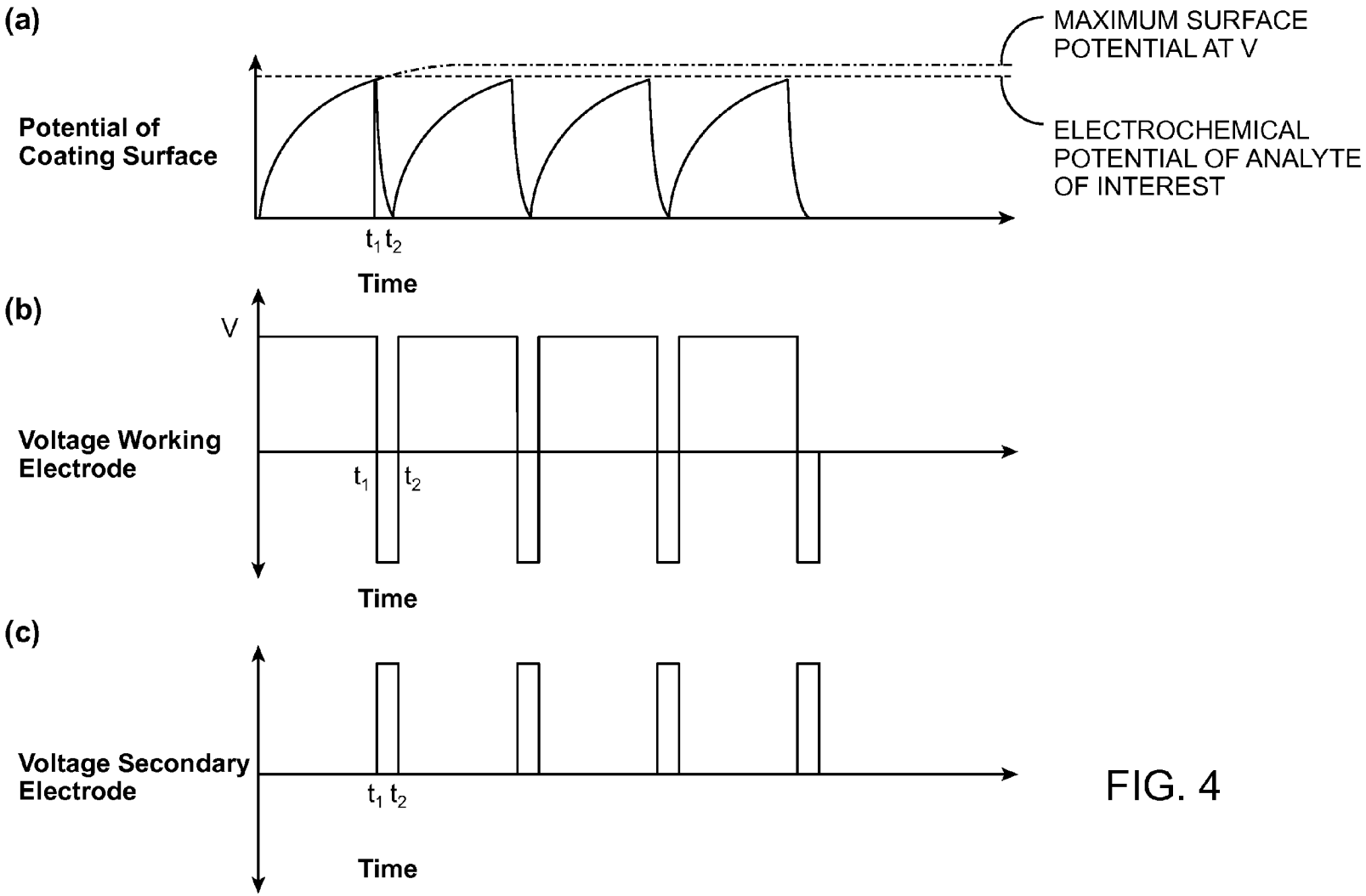
FIG. 4 is a diagram showing (a) the surface potential of a charge storage coating, (b) the voltage applied to the primary working electrode, and (c) the voltage applied to a secondary working electrode, in an exemplary embodiment of the invention.

As used herein, the term "charge storage coating" is used to describe coatings such as electrochemically active polymers, inorganic dielectric materials, and combinations thereof, that are capable of (i) coating the surface of the working electrode, and (ii) preventing electrochemistry of the analyte of interest by providing a gradual surface potential increase, such as that shown in FIG. 4. The charge storage coatings disclosed herein can form a stable coating on an electrode surface and achieve a charge density having a magnitude of at least 10 $\mu C/cm^2$, at least 20 $\mu C/cm^2$, or at least 50 $\mu C/cm^2$ during used of the ESI source described herein.

In preventing electrochemistry of an analyte of interest, charge storage coatings provide two primary functions. First, charge storage coatings serve as a physical barrier to prevent electrochemical reactions between the analyte of interest and the working electrode. Second, charge storage coatings serve to delay the increase of surface potential, as compared to an uncoated electrode surface 16, 25, in order to avoid electrochemistry of low oxidation potential or high reduction potential analytes of interest.

As used herein, the term "electrochemically active polymer" is used to describe electrically electrochemically active polymers that can be used to form a charge storage coating. Electrochemically active polymers include redox polymers, which can be oxidized and/or reduced, as well as, conductive polymer. The electrochemically active polymers described herein can have an electron transfer rate such that the electrochemically active polymers are capable of being discharged (conductive polymers) or recharged (from fully oxidized state to fully reduced state, or vice versa) in 1 second or less during a pulsed voltage change. Electrochemically active polymers include, but are not limited to, poly(acetylene)s, poly(pyrrole)s, poly(thiophene)s, poly(aniline)s, poly(fluorene)s, poly(3-alkylthiophene)s, polytetrathiafulvalenes, polynaphthalenes, poly(p-phenylene sulfide)s, poly(phenylene vinylene)s, poly(paraphenylene)s, poly(viologen)s, and copolymers and mixtures thereof.

Figure 5:
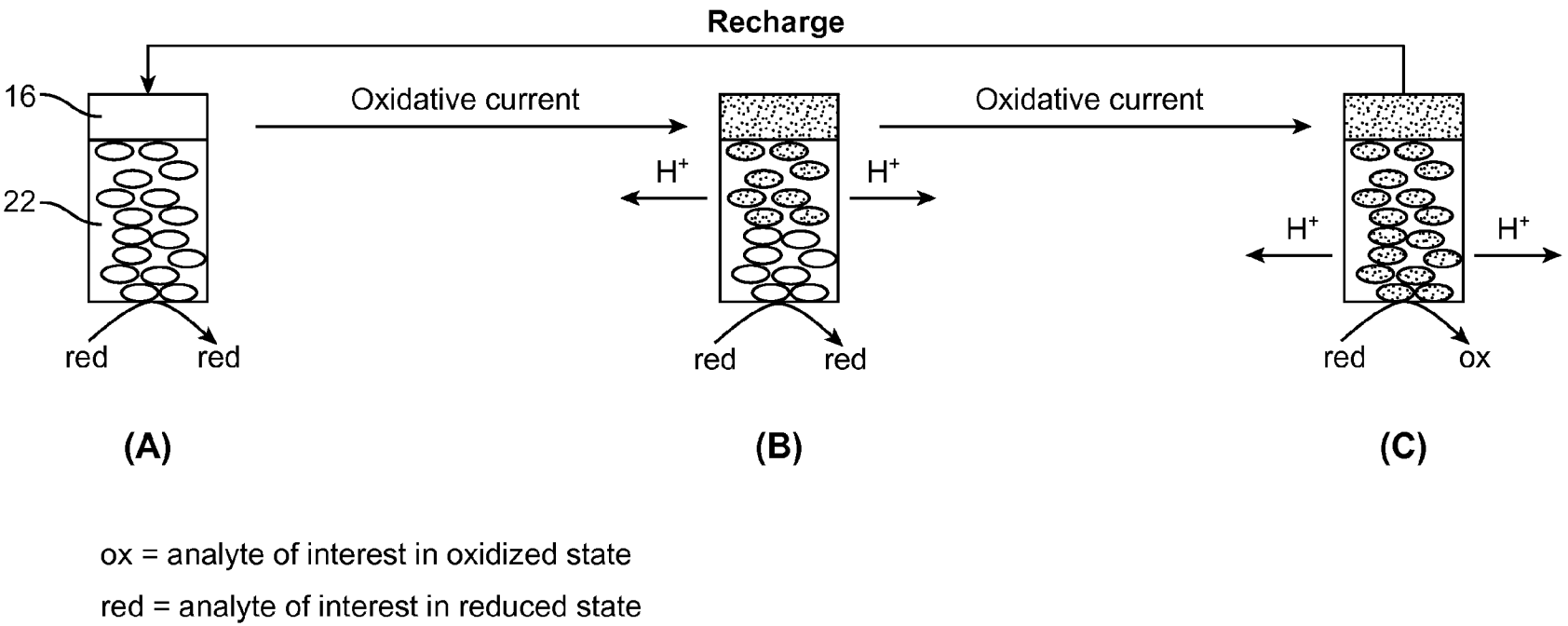
FIG. 5 is a schematic of the interaction between an analyte and an electrode covered with a electrochemically active polymer when the electrochemically active polymer is at various levels of charge accumulation.

An example of a electrochemically active polymer acting as a capacitive material to prevent oxidation of an analyte molecule is shown by the sequence in FIG. 5. In particular, FIG. 5 shows a schematic of the sequence where the analyte molecule has a low electrochemical potential for oxidation, e.g., reserpine. The analyte molecule is represented by "red", whereas the oxidized analyte molecule is represented by "ox." As shown in FIG. 5(A), when the electrochemically active polymer 22 is in a discharged state, the analyte molecule contacts the surface of the electrochemically active polymer 22 and does not undergo an electrochemical reaction.

As shown in FIG. 5(B), once exposed to charge, the electrochemically active polymer 22 begins to accumulate charge, e.g., undergo oxidation. However, the surface potential, e.g., charge accumulation, at the surface of the electrochemically active polymer 22 is less than the amount sufficient to trigger oxidation of the analyte molecule. In FIG. 5, the accumulation of charge is represented by the dark ovals in the electrochemically active polymer 22.

As shown in FIG. 5(C), at some point the surface potential, e.g., charge accumulation, at the surface of the electrochemically active polymer 22 exceed a threshold amount and some analyte molecules may be oxidized. As shown in FIG. 5, the electrochemically active polymer 22 can be returned to its discharged state during a pulsed voltage change.

As used herein, the term "inorganic dielectric material" is used to describe charge storage coatings made from inorganic materials that have a high relative permittivity or high capacitance, i.e., they are useful as the dielectric of a capacitor. The inorganic dielectric materials described herein can have an electron transfer rate such that the inorganic dielectric materials are capable of being discharged in 1 second or less. Exemplary inorganic dielectric materials include, but are not limited to, barium titanate, zirconium barium titanate, strontium titanate, calcium titanate, magnesium titanate, calcium magnesium titanate, zinc titanate, lanthanum titanate, neodymium titanate, barium zirconate, calcium zirconate, lead magnesium niobate, lead zinc niobate, lithium niobate, barium stannate, calcium stannate, magnesium aluminium silicate, magnesium silicate, barium tantalate, titanium dioxide, niobium oxide, zirconia, silica, sapphire, beryllium oxide, zirconium tin titanate, and combinations thereof.

The power system 28 can include a processor 29 for delivering a pulsed voltage change to the primary working electrode 16 during operation of said electrospray ion source 10. The power system 28 can be designed to automatically deliver a second pulsed voltage change to the secondary working electrode 21 during at least a portion of the pulsed voltage change. The pulsing function has the benefit of allowing the charge storage coating 22 to discharge, which reduces the potential of the liquid contacting surface of the charge storage coating 22. Proper timing of the voltage pulses to the primary working electrode 16 can prevent the charge storage coating 22 from accumulating sufficient surface charge to produce an electrochemical reaction with the analyte of interest in the liquid. As will be recognized, the threshold surface potential necessary to produce an electrochemical reaction will vary depending on the analyte of interest.

In one embodiment, the primary working electrode 16 and the secondary working electrode 21 can both be coated with a charge storage coating 22, 27. The processor 29 can be programmed to have the power system 28 switch between the working electrodes 16, 21 at intervals determined to prevent the charge storage coating 22, 27 from reaching a predetermined surface potential, e.g., the electrochemical potential of an analyte of interest, while maintaining continuous operation of the ESI source.

For example, as shown in FIGS. 4(*b*) and (*c*), the primary working electrode 16 can receive a first voltage while the secondary working electrode 21 is disconnected from the power supply or maintained at a voltage such that the surface potential of the secondary charge storage coating 27 is below an electrochemical potential of the analyte of interest, e.g., V=0 volts (when $t<t_1$). When the surface potential of the surface of the charge storage coating 22 reaches a predetermined level, e.g., the electrochemical potential of the analyte of interest, a pulsed voltage change can be applied to the primary working electrode 16 and a secondary voltage can be applied to the secondary working electrode 21. In FIG. 4, the pulsed voltage change is applied at $t_1$. The duration of the pulsed voltage change can be sufficient to reduce the surface potential of the surface of the charge storage coating 22 to approximately the ground state (potential ~0 volts), as shown in FIG. 4(*a*), or some other surface potential below the electrochemical potential of the analyte of interest. The primary working electrode 16 can be disconnected form the power system 28 for the duration of the pulsed voltage change. Once the surface potential is sufficiently reduced, e.g., $t_2$ in FIG. 4, the primary working electrode 16 can be returned to the first voltage.

In another variation, the secondary pulsed voltage change can be applied to the secondary working electrode 21 until the secondary charge storage coating 27 reaches a predetermined level. At that time, the secondary working electrode 21 can be disconnected from the power supply, returned to 0 volts, or the voltage supplied to the second working electrode 21 otherwise reduced such that the surface potential is below the electrochemical potential of the analyte of interest. The pulsed voltage change to the working electrode 16 can be terminated, i.e., the first voltage is applied to the primary working electrode 16. This sequence can be repeated each time one of the charge storage coatings 22, 27 reaches a predetermined level, e.g., where the surface potential of the charge storage coating 22, 27 could cause electrochemical reactions with the analyte. Although the pulsed voltage changes are described as terminating when the next pulsed voltage change begins, they can overlap in order to maintain continuous operation. In addition, the voltage applied to the working electrodes 16, 21 during the pulsed voltage changes can have an opposite polarity of the first voltage and the secondary voltage, respectively.

The processor 29 can include the capability to compare a parameter of the analyte of interest, e.g., electrochemical potential, with the surface potential at the charge storage coating surface 31. The electrospray ion source 10 can include a sensor 36 for detecting a parameter of the charge storage coating 22. The parameter of the charge storage coating 22 can be from surface potential, color, conductivity, parameters related to oxidation state, and combinations thereof.

The ESI source 10 can also include a secondary sensor (not shown) for detecting a parameter of the secondary charge storage coating 27. In the alternative, or as a backup, the ESI can also be programmed with parameters used to estimate the surface potential of the charge storage coatings 22, 27. For example, the RC time constant can be determined based on experiments or the thickness, area and composition of the charge storage coating.

In one embodiment, a user can provide the processor 29 with the threshold electrochemical potential for oxidation or reduction of the analyte of interest or select a parameter from a database of parameters for known analytes of interest that can be accessed by the processor 29. The processor 29, via the power system 28, can apply a voltage to the primary working electrode 16, the counter electrode 24, or both. The processor 29 can use the sensor 36 to monitor the selected parameter, such as the surface potential, of the charge storage coating 22 and provide a pulsed voltage change to the working electrode 16 when the surface potential of the charge storage coating 22 approximates the electrochemical potential for oxidation or reduction of the analyte of interest. For example, the pulsed voltage change can be applied when the surface potential of the working electrode is within 0.5 V of the electrochemical potential for oxidation or reduction of the analyte of interest, or within 0.2 V, or within 0.1 V, or equal to the electrochemical potential for oxidation or reduction of the analyte of interest. The pulsed voltage change can be of sufficient duration and magnitude to reduce the surface potential of the charge storage coating 22 by at least 50%, or by at least 75%, or by at least 85% or by at least 95%, or by at least 98%. The pulsed charge can be of sufficient duration and voltage to reduce the surface potential of the charge storage coating 22 to below the electrochemical potential of the analyte of interest, i.e., analyte molecule. The voltage of the working electrode 16 can then be returned to the pre-pulse value.

Although not intended to be limiting, the pulsed voltage change can include reducing the voltage applied to the working electrode below the electrochemical potential of the analyte of interest. The pulsed voltage change can also include applying a voltage to the working electrode that is opposite in polarity to the pre-pulse value, e.g., the first voltage. As shown in FIG. 4(*b*), the pulsed voltage change can include switching the polarity while maintaining the same magnitude, i.e., switching from positive ion mode to negative ion mode, or vice versa. The duration of the pulsed voltage change applied to the working electrode can be any length of time, including 10 second or less, 1 second or less, 500 milliseconds or less, 100 milliseconds or less, 10 milliseconds or less, or 1 millisecond or less.

The processor can apply a second pulsed voltage change to the secondary working electrode 21 while the pulsed voltage change is being applied to the primary working electrode 16. For example, a second pulsed voltage change can be of sufficient duration and magnitude to maintain continuous operation of the electrospray ion source during the pulsed voltage change. As used herein, continuous operation is intended to mean that a stream of analyte of interest ions is produced sufficient for accurate measurements using an analytical instrument, e.g., a mass spectrometer.

Although not shown, it is envisioned that additional electrodes, whether coated or not, can be included in the electrospray ion source and method described herein. Each of these additional electrodes can be connected to the power system 28, can include a sensor, and can have a pulsed voltage change applied thereto as necessary.

All analytes molecules in the fluid will not immediately undergo oxidation or reduction the instant that the electrochemical potential of the analyte molecule is reached at the surface of the charge storage coating 22, 27. Rather, the amount of oxidation or reduction that occurs can be a function of, among other parameters, the surface potential of the charge storage coating 22, 27 and the period of time that the surface potential of the charge storage coating 22, 27 exceeds a certain threshold, e.g., the electrochemical potential of the analyte molecule. The second pulsed voltage change applied to the second working electrode 21 can begin prior to the pulsed voltage change applied to the primary working electrode 16, simultaneously with the pulsed voltage change or after the pulsed voltage change begins, so long as continuous operation of the electrospray ion source is maintained.

The duration that the ionizing voltage, i.e., the voltage necessary to maintain continuous operation, can be applied to each electrode 16, 21 can be controlled, in part, by the composition of the charge storage coating 22, 27 and the thickness there of.

The charge storage coatings can be applied by any method known to those of skill in the art including, but not limited to, electrochemical methods, e.g., electropolymerisation; chemical methods, e.g., chemical polymerization, sintering; or physical methods, e.g., spray paint, painting, dip coating, adhering, etc.

In another embodiment, the invention is drawn to a method of ionizing an analyte of interest without the analyte of interest undergoing an electrochemical reaction. The method can include providing an electrospray ion source that can include a liquid conduit 14, a primary working electrode 16 having a liquid contacting surface 18, a charge storage coating 22 disposed partially or fully over the liquid contacting surface 18, and a counter electrode 24 proximate to, but separated from, the liquid conduit 14, wherein the primary working electrode 16 and the liquid conduit 14 are in liquid communication. A liquid 26 comprising an analyte of interest can be conveyed through the liquid conduit 14. A first voltage can be applied to the working electrode 16. A pulsed voltage change can be applied to the working electrode 16, wherein the pulsed voltage change is effective for reducing the surface potential of the charge storage coating 22.

The pulsed voltage change can include applying to the working electrode a voltage having a polarity opposite that of said first voltage. The pulsed voltage change can include reducing the magnitude of the voltage applied to the electrode 16, 21, e.g., voltage=0 volts. The duration of the pulsed voltage change, the secondary voltage change, or both, can be 10 seconds or less. The duration of the pulsed voltage change, the secondary voltage change, or both, can be 1 second or more.

The electrospray ion source can also include a secondary working electrode 21 in liquid communication with the working electrode 16 and the liquid conduit 14. The method can also include applying a secondary voltage to the secondary working electrode 21 and applying a secondary pulsed voltage change to the secondary working electrode 21. The secondary pulsed voltage change and the pulsed voltage change can overlap; however, the pulsed voltage changes need not begin and end simultaneously. The pulsed voltage changes can be coordinated such that the duration, magnitude and timing of the pulsed voltage changes are sufficient to maintain continuous operation of the electrospray ion source.

The secondary working electrode 21 comprises a secondary liquid contacting surface 25 having a secondary charge storage coating 27 disposed partially or fully over the secondary liquid contacting surface 25.

In contrast to prior art redox buffering techniques, which introduce chemicals in the solution during their operation that may react the analyte of interest causing an undesirable mass shift and/or signal suppression, the inventive electrospray ion sources generate only excess charge polarity in solution without electrolysis of the analyte of interest. In summary, emitters coated with compounds that generate only excess charge polarity in solution provide a way to eliminate analyte electrochemistry.

EXAMPLES

It should be understood that the Examples described below are provided for illustrative purposes only and do not in any way limit the scope of the invention.

Application of a Electrochemically Active Polymer

An emitter having a electrochemically active polymer coating was prepared in an off-line electrochemical process. In the electrochemically active polymer application process, polypyrrole (PPy) was electropolymerized onto a 6 mm diameter gold thin-layer flow cell electrode, i.e., the working electrode, from a solution containing 50 mM pyrrole and 0.3M ammonium acetate in water by applying a voltage to the working electrode.

Mass Spectrometry Results for Reserpine

Two mass spectra of an oxidation sensitive compound, reserpine, were acquired in positive ion mode. The first using a gold thin-layer flow cell electrode and the second using the same electrode coated with a polypyrrole coating prepared as described above.

Figure 6:
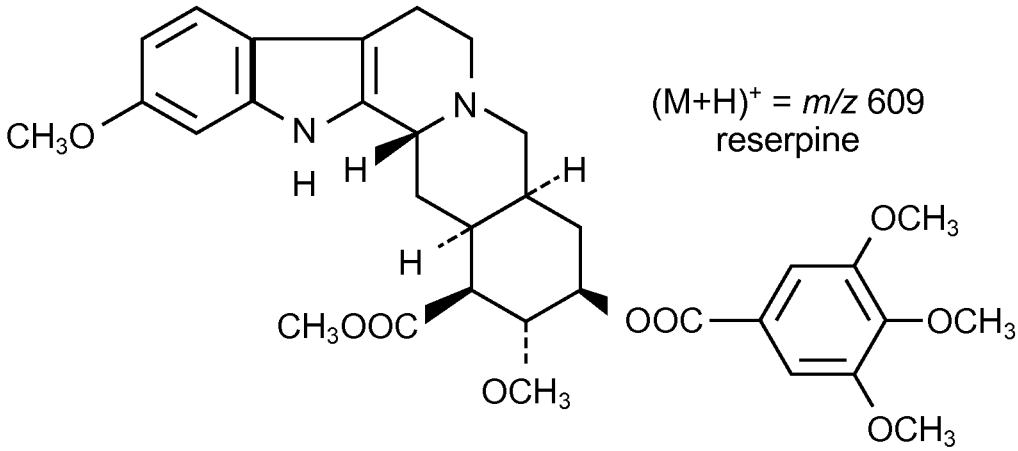
FIG. 6 shows the chemical structure of reserpine and the oxidation states thereof.
Figure 6:
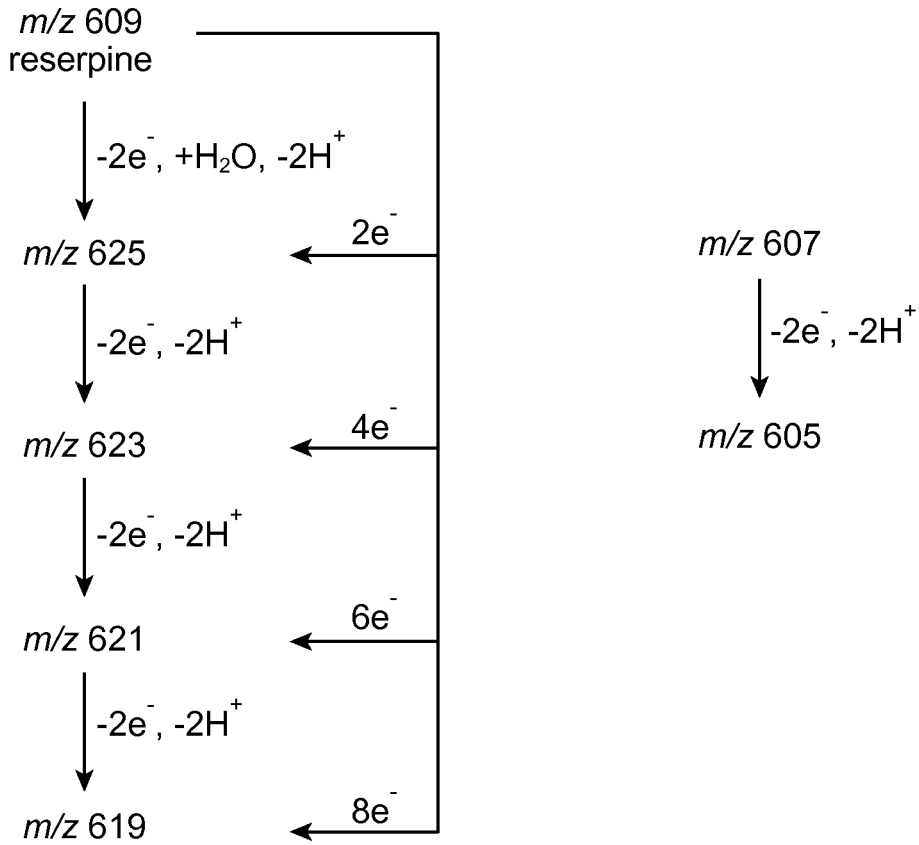
Figure 7:
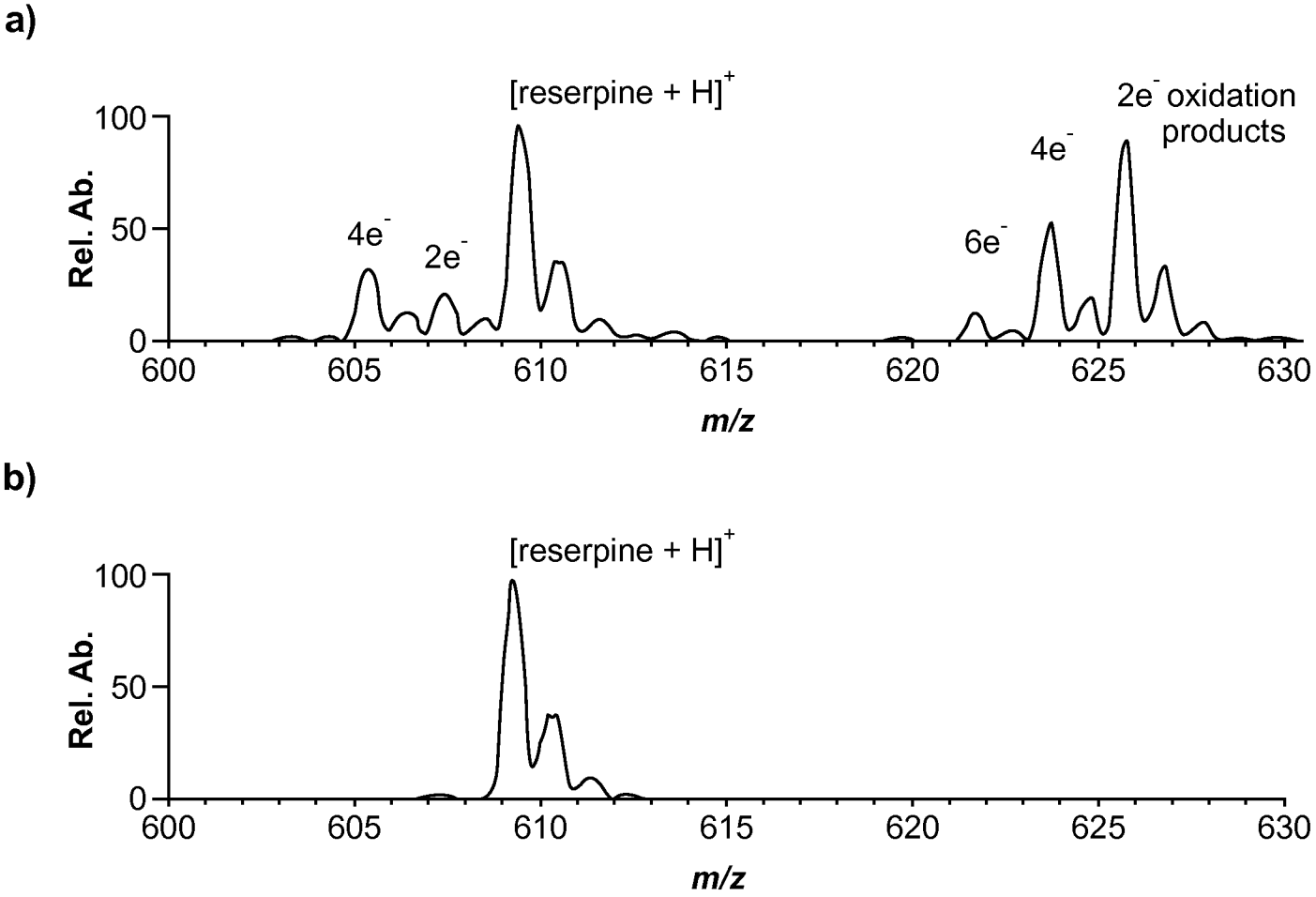
FIG. 7 shows the mass spectra of reserpine evaluated using (A) a conventional electrospray ion source, and (B) an electrospray ion source using an electrode coated with a charge storage coating.

The structure of reserpine and the proposed oxidation pathways and ions observed in positive ion mode are shown in FIG. 6. The results for (A) the bare gold electrode, and (B) the PPy-coated gold electrode are shown in FIG. 7. As is evident from the mass spectra of FIG. 7(A), the bare gold electrode efficiently oxidizes reserpine to its 2-, 4- and 6-electron oxidation products. On the other hand, the mass spectra of FIG. 7(*b*) clearly shows only one peak representing the initial compound, reserpine, which is evidence that the PPy-coated gold electrode does not produce any electrochemical reactions with reserpine.

It is to be understood that while the invention has been described in conjunction with the preferred specific embodiments thereof, that the foregoing description as well as the examples which follow are intended to illustrate and not limit the scope of the invention. Other aspects, advantages and modifications within the scope of the invention will be apparent to those skilled in the art to which the invention pertains.

We claim:

1. An electrospray ion source, comprising:

an emitter comprising, a liquid conduit, a primary working electrode having a liquid contacting surface, a spray tip, and a charge storage coating disposed over the liquid contacting surface of the working electrode, the said charge storage coating comprising an inorganic dielectric material, wherein said liquid conduit and said working electrode are in liquid communication;

a counter electrode proximate to, but separated from, said spray tip; and a power system for supplying voltage to said working electrode, wherein said power system is controlled by a processor for delivering a pulsed voltage change to the working electrode during operation of said electrospray ion source.

2. The electrospray ion source of claim 1, further comprising a secondary working electrode, where said power system is capable of delivering voltage to said secondary working electrode.

3. The electrospray ion source of claim 2, wherein said secondary working electrode has a liquid contacting surface having a second charge storage coating disposed thereon.

4. The electrospray ion source of claim 2, wherein said power system is designed to automatically deliver a second pulsed voltage change to the secondary working electrode during at least a portion of the pulsed voltage change.

5. The electrospray ion source of claim 1, wherein the pulsed voltage change comprises reversing polarity of the voltage supplied to the working electrode.

6. The electrospray ion source of claim 1, wherein the duration of the pulsed voltage change is less than 1 second.

7. The electrospray ion source of claim 1, wherein said inorganic dielectric material is selected from the group consisting of barium titanate, zirconium barium titanate, strontium titanate, calcium titanate, magnesium titanate, calcium magnesium titanate, zinc titanate, lanthanum titanate, neodymium titanate, barium zirconate, calcium zirconate, lead magnesium niobate, lead zinc niobate, lithium niobate, barium stannate, calcium stannate, magnesium aluminium silicate, magnesium silicate, barium tantalate, titanium dioxide, niobium oxide, zirconia, silica, sapphire, beryllium oxide, zirconium tin titanate, and combinations thereof.

8. The electrospray ion source of claim 1, further comprising a sensor for detecting a parameter of the charge storage coating, wherein said sensor is in communication with said processor.

9. The electrospray ion source of claim 8, wherein the parameter is selected from the group consisting of surface potential, color, conductivity, parameters related to oxidation state, and combinations thereof.

10. A method of ionizing an analyte of interest, comprising:

conveying a liquid comprising an analyte of interest through an electrospray ion source, having a working electrode having a charge storage coating disposed over a liquid contacting surface of said working electrode, the said charge storage coating comprising an inorganic dielectric material;

applying a first voltage to said working electrode, wherein said first voltage is interrupted by one or more pulsed voltage changes, which maintain a surface potential of a liquid contacting surface of said charge storage coating below a threshold necessary to cause electrochemistry with the analyte of interest.

11. The method of claim 10, wherein the pulsed voltage change comprises applying to said working electrode a voltage having a polarity opposite that of said first voltage.

12. The method of claim 10, wherein the duration of the pulsed voltage range is 1 second or less.

13. The method of claim 10, wherein the electrospray ion source comprises a secondary working electrode in liquid communication with said working electrode and said liquid conduit, and the method further comprises applying a secondary pulsed voltage change to said secondary working electrode, wherein said secondary pulsed voltage change and said voltage change overlap.

14. The method of claim 10, wherein said inorganic dielectric material is selected from the group consisting of barium titanate, zirconium barium titanate, strontium titanate, calcium titanate, magnesium titanate, calcium magnesium titanate, zinc titanate, lanthanum titanate, neodymium titanate, barium zirconate, calcium zirconate, lead magnesium niobate, lead zinc niobate, lithium niobate, barium stannate, calcium stannate, magnesium aluminium silicate, magnesium silicate, barium tantalate, titanium dioxide, niobium oxide, zirconia, silica, sapphire, beryllium oxide, zirconium tin titanate, and combinations thereof.

* * * * *